US006370713B2

(12) United States Patent
Bosio

(10) Patent No.: US 6,370,713 B2
(45) Date of Patent: Apr. 16, 2002

(54) PULL-OUT SHOWER HEAD FOR KITCHEN

(75) Inventor: Orlando Bosio, Casaloldo (IT)

(73) Assignee: AMFAG S.p.A., Castelgoffredo (IT)

( * ) Notice: Subject to any disclaimer, the term of this patent is extended or adjusted under 35 U.S.C. 154(b) by 0 days.

(21) Appl. No.: 09/797,573

(22) Filed: Mar. 5, 2001

(30) Foreign Application Priority Data

Mar. 10, 2000 (IT) ..... MN00A0013

(51) Int. Cl.[7] ..... E03C 1/05; B05B 1/16

(52) U.S. Cl. ..... 4/677; 239/441; 239/449; 239/548; 239/553.3; 239/553.5; 239/558; 239/562; 239/586

(58) Field of Search ..... 4/677, 676; 239/25, 239/441, 446, 447, 448, 449, 553.3, 553.5, 558, 562, 586, 548

(56) References Cited

U.S. PATENT DOCUMENTS 4,117,979 A * 10/1978 Lagarelli et al. ..... 239/441 X
5,860,599 A * 1/1999 Lin ..... 239/447 X
6,290,147 B1 * 9/2001 Bertrand et al. ..... 239/444
6,296,011 B1 * 10/2001 Esche et al. ..... 239/586 X

* cited by examiner

*Primary Examiner*—Gregory L. Huson
*Assistant Examiner*—Kathleen J. Prunner
(74) *Attorney, Agent, or Firm*—Guido Modiano; Albert Josif; Daniel O'Byrne

(57) ABSTRACT

A pull-out spray head, which is connectable with a faucet by a flexible hose, has a water conveyance body disposed within an outer enclosure. The water conveyance body has a cavity which is arranged substantially transversely to the water delivery direction, has an opening facing toward the water intake duct defined by the body, and is divided into two facing portions on opposite sides with respect to the opening. Each facing portion has a water delivery port connected, respectively, to the peripheral ports and to the central port of a disk which locks the body within the enclosure. One of the facing portions is provided with a hollow plug or slider which includes a port for connection to the water delivery port of that one facing portion. A flow control element is positioned within the body and has a rod which protrudes outwardly of the enclosure so as to be connected to an actuation lever.

19 Claims, 9 Drawing Sheets

6a
6
5a
11
1
5
17b
24b
6b
6b
17
14b
8
20
19c
14c
14a
8b
10
14d
21
17d
24
22
16
14
24a
8a
13
20a
9a
19
23
16a
19a
18
12
6c
6
19b
16
15
17c
5c
7a
7c
7b
7d
7

26a
26
31
25a
25
37
39
30
34a
33
40
41
28b
28
34
42
40a
36
39a
28a
29
39c
39b
36a
38
29a
35
36
32
35
27a
27
27b
27c

PULL-OUT SHOWER HEAD FOR KITCHEN

BACKGROUND OF THE INVENTION

The invention relates to a pull-out shower head for a kitchen.

The great diffusion achieved by so-called shower heads for a kitchen is known; said shower heads are connected to a flexible hose so that they can be pulled out from faucets in order to reach distant positions within sinks, as occurs in particular in large kitchens of the professional type, and convey water with the possibility to provide discharge in the form of a central jet or of a peripheral jet by way of a simple maneuver on an appropriately provided device.

One very common form of said shower heads provides for the presence of a substantially cylindrical portion which is connected, at one end, to a water dispensing nozzle, essentially forming a pipe-like shape which entails some problems in terms of handling by the user.

A pull-out shower head which comprises a body whose shape allows a user to grip it easily for comfortable use in professional kitchens has also been proposed; however, it has disadvantageous characteristics owing to a certain complexity in construction and assembly.

SUMMARY OF THE INVENTION

The aim of the present invention is to provide a pull-out shower head for a kitchen which offers maximum comfort in handling and great simplicity in construction and assembly.

This aim is achieved by a kitchen pull-out shower head, according to the invention, comprising a water conveyance body having, at its intake end, means for coupling to a flexible hose comprised within a faucet, and is associated, at its delivery end, with a disk comprising a central port and peripheral ports for water passage, characterized in that said body comprises a cavity being arranged substantially transversely to the water delivery direction and having an opening toward a duct which branches off from the water intake end and is divided into two facing portions which lie on opposite sides with respect to said opening, each portion comprising a water delivery port, one of said ports being adapted to be connected to the peripheral ports, the other port being suitable to be connected to the central water passage port that is comprised within said disk, at least one of said portions being provided with a hollow plug which comprises a port for connection to the water delivery port that is comprised within said portion, a flow control element being provided which has a rod which protrudes externally so as to be associated with an actuation lever, and is suitable to abut, on opposite sides, with sealing surfaces at the water intake section respectively of the portion that is not provided with the plug and of the cavity of the plug comprised within the other portion.

BRIEF DESCRIPTION OF THE DRAWINGS

Further characteristics and advantages of the invention will become better apparent from the following detailed description of preferred but not exclusive embodiments thereof, illustrated only by way of non-limitative examples in the accompanying drawings, wherein.

DESCRIPTION OF THE PREFERRED EMBODIMENTS

Figure 1:
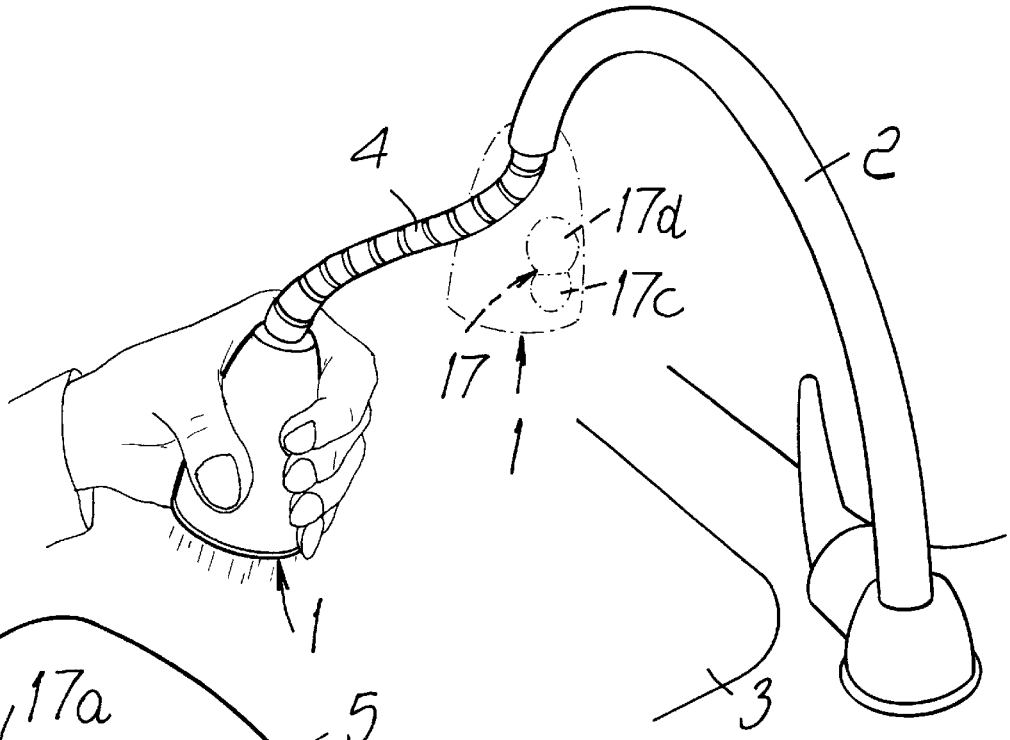
FIG. 1 is a view of the invention during use.
Figure 3:
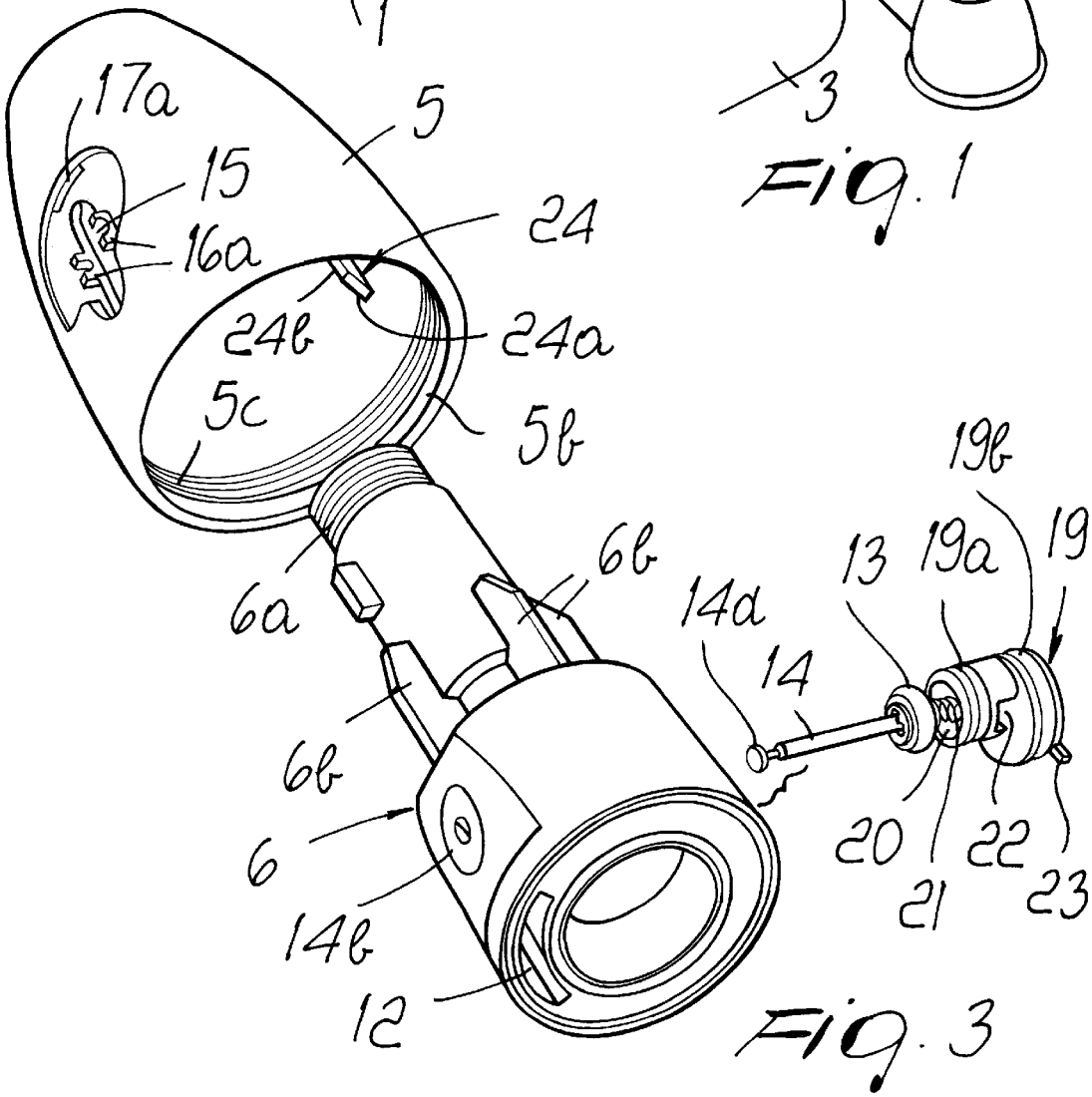
FIG. 3 is an exploded view of the invention.

With reference to FIGS. 1 to 6, reference numeral 1 generally designates the shower head, which is shown in FIG. 1 in two positions: one position, shown in dot-and-dash lines, in which it is in contact with the end of the faucet 2 on the sink 3, and a position, shown in solid lines, in which the shower head has been gripped by a user and moved away from the faucet 2 in order to reach, with a localized jet, distant positions in the sink by taking advantage of the presence of the flexible hose 4 which is comprised within the faucet 2 and is associated, in manners described hereafter, with said shower head 1.

The shower head 1 comprises the outer enclosure 5, which is formed as a solid of revolution which allows comfortable grip by a user and has two substantially opposite openings 5*a* and 5*b;* the central conveyance body 6, meant to convey water from the intake end, which is provided with a coupling means in the form of a thread 6*a* for coupling to the flexible hose 4, is contained and locked within said outer enclosure.

The central body 6, which has reinforcement fins such as 6*b,* is locked within the outer enclosure 5 by means of the disk 7, which has an external thread, is associated with said outer enclosure by means of the thread 5*c,* and is adapted to abut against said central body 6 at the water delivery end. The disk 7 comprises the central water delivery port 7*a,* which is provided with the filters and aerator set 7*b,* and ports such as 7*c,* 7*d* to discharge water in the form of a peripheral jet.

The central body 6 comprises a cavity which is arranged substantially transversely to the water delivery direction and is divided into two facing portions 8 and 9 which lie on opposite sides with respect to the opening 10 which connects said cavity to the duct 11 which branches off from the water intake end.

Figure 2:
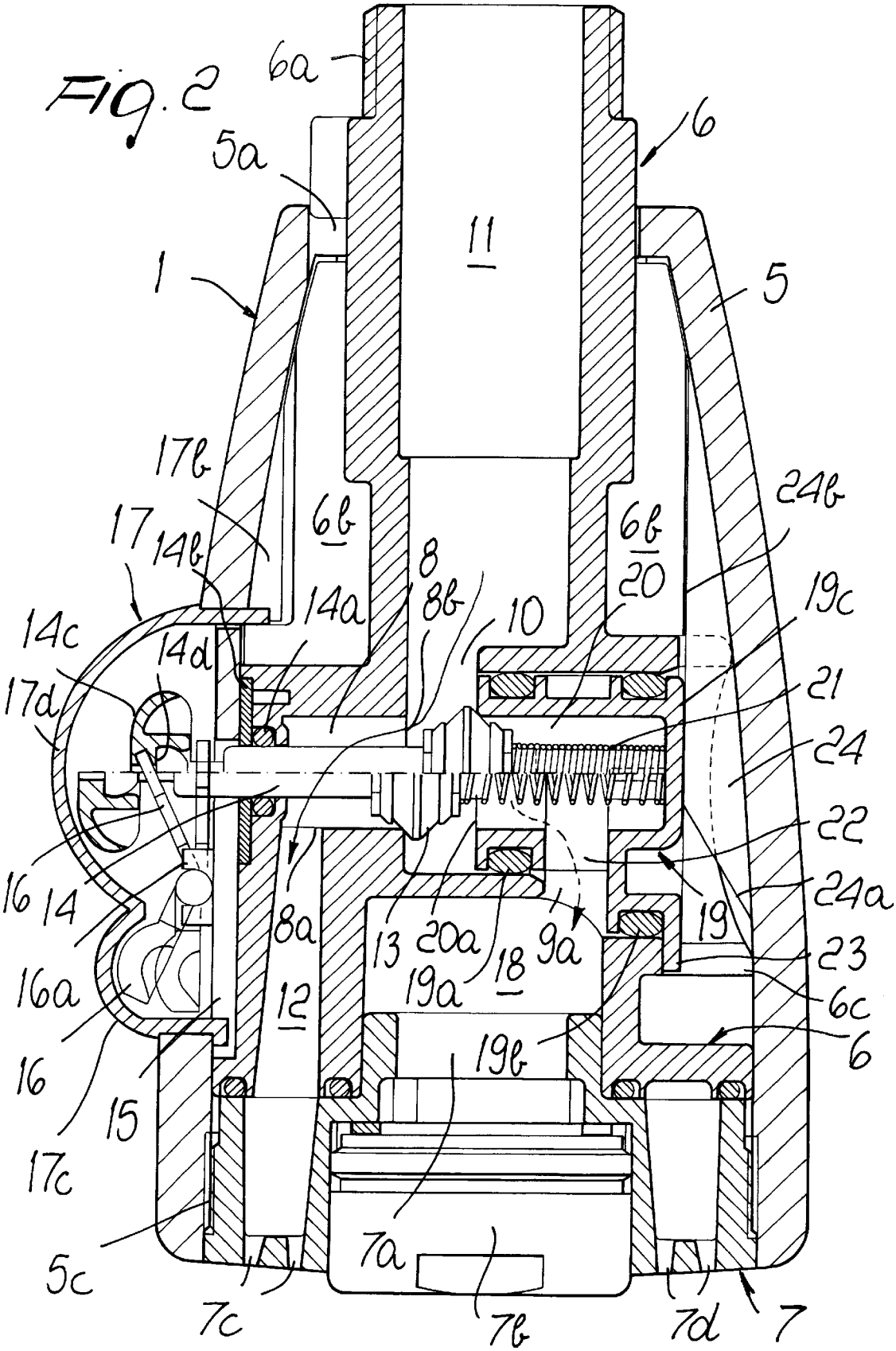
FIG. 2 is a sectional view of the invention, taken along a longitudinal plane, in the fully assembled condition.

The cavity portion 8 is provided with a port 8*a* for the discharge of the water toward the duct 12, which is connected to the ports such as 7*c,* 7*d* of the disk 7 that provide the peripheral jet, and is shaped at the water intake section so as to form the surface 8*b* that provides a seal by abutment against the flow control element 13 connected to the rod 14, which is shown in FIG. 2 in two operating positions, as detailed hereinafter.

Said rod 14 protrudes from the bottom of the cavity portion 8 through a passage hole which is protected by the gasket 14*a,* which is locked by means of the plate 14*b,* and protrudes from the slot-shaped opening 15 which lies longitudinally along the wall of the outer enclosure 5. In this manner the rod 14 is associated with the actuation lever 16, which will be described further hereinafter and is pivoted on the support 16*a.*

Reference numeral 17 designates a covering hood which is associated with the outer enclosure 5 by insertion of a tab provided at one end of the hood in the hole 17*a,* with locking on the tooth 17*b,* and of a tab at the other end thereof in the end region of the opening 15. The hood is made of elastic material and is shaped so as to form two regions 17*c,* 17*d* which lie respectively over the end of the lever 16 and over the button 14*c,* which is located at the partially spherical end of the rod 14 and is associated therewith at the flat face 14*d* which prevents abnormal movements. The regions are highly differentiated in terms of their dimensions so that they can be easily recognized by the user simply by touch.

The cavity portion 9 is provided with the port 9*a* for delivering the water toward the portion of space 18 connected to the central port 7*a* of the disk 7 and is suitable to contain the hollow movable plug or slider 19 with sealing gaskets 19*a,* 19*b.*

Said slider 19 comprises the cavity 20, which has a water intake opening delimited by the surface 20*a* for providing a seal by abutment against the flow control element 13 and contains the spring 21 for actuating said flow control element 13, said spring being associated with the bottom 19*c* of the slider; the numeral 22 furthermore designates a connection port which is provided in the wall of the slider 19 and is suitable to connect the cavity 20 to the water delivery port 9*a,* and the numeral 23 designates a tooth which protrudes from said slider in order to keep it in position during the movements described hereinafter, being able to slide within a guide 6*c* formed in the central body 6.

Finally, reference numeral 24 designates a ridge which protrudes from the internal surface of the wall of the outer enclosure 5 and comprises an inclined portion 24*a* and a longitudinal portion 24*b;* said ridge is suitable to move the slider 19 during the insertion, on assembly, of the central body 6 in the outer enclosure 5, in a manner described hereafter.

The per se known operation of the device for switching from the central jet to the peripheral jet and vice versa is briefly described with reference to FIG. 2, which illustrates the shower head in a fully assembled condition and in the operating position.

With the faucet closed, the spring 21 pushes the flow control element 13 against the sealing surface 8*b,* as shown in the lower region of FIG. 2, so as to produce the central-jet condition when the faucet opens; the water, arriving from the duct 11, in fact enters the cavity 20 of the slider 19, passing through 20*a,* and then reaches, by following the dashed-line path of FIG. 2 through the ports 22 and 9*a,* the portion of space 18 that is connected to the central port 7*a* of the disk 7.

If one wishes to switch the jet from central to peripheral, it is sufficient to press the button 14*c,* so as to move the flow control element 13 into the condition shown in the upper region of FIG. 2, i.e., in contact with the sealing surface 20*a.* The water traces the path shown in solid lines in FIG. 2 and the peripheral jet is produced through the ports such as 7*c,* 7*d.*

The situation is maintained by virtue of the passage of the water, and if one wishes to return to the central-jet condition it is sufficient to press the end of the lever 16, i.e., close the faucet.

The method of assembling the shower head according to the invention is of primary interest and is now described with reference to FIGS. 4, 5 and 6.

The assembly formed by the slider 19 with the spring 21 and the flow control element 13 with the corresponding rod 14 is assembled first; then the assembly is inserted in the cavity portion 9 of the central body 6, taking care to place the end of the rod 14 at the hole provided on the bottom of the cavity portion 8, which is controlled by the gasket 14*a.*

Figure 4:
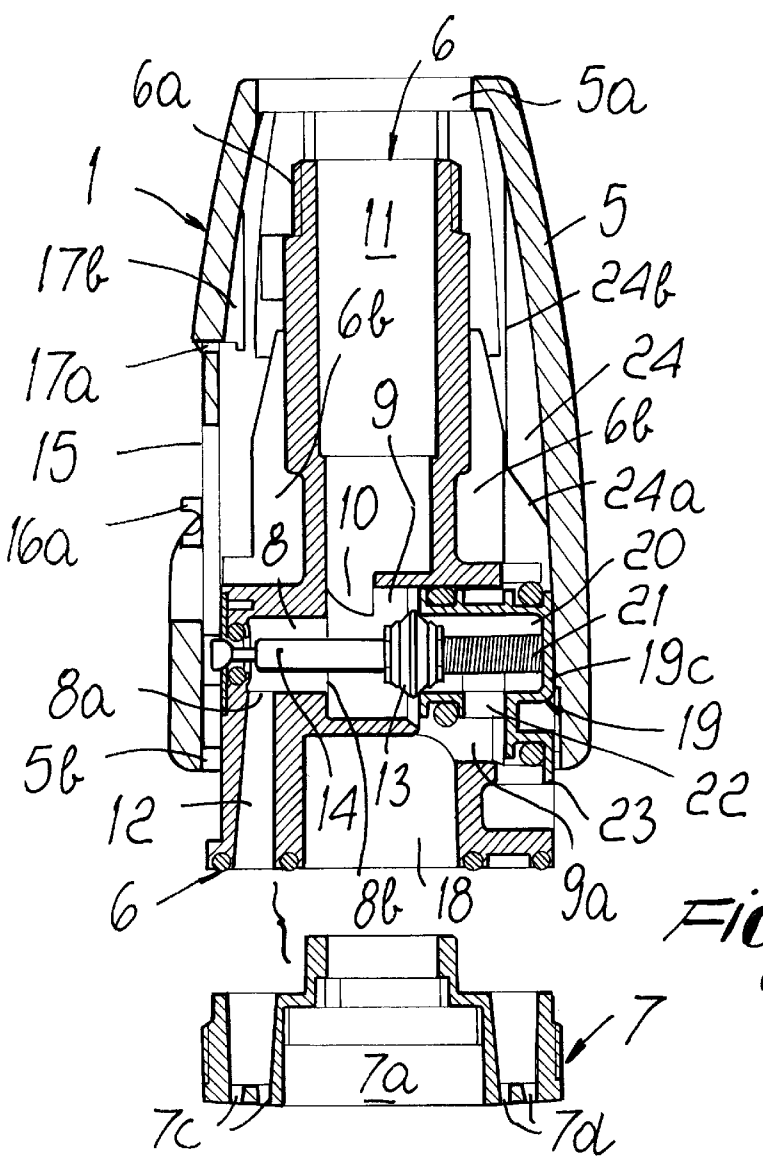

At this point, the central body 6 is inserted in the outer enclosure 5, and during the first steps of insertion, such as the one shown in FIG. 4, passage is allowed by the fact that the bottom of the slider 19 and the end of the rod 14 skim the internal surface of the wall of said outer enclosure 5, in conditions of minimum axial space occupation achieved by virtue of the resiliency of the spring 21, which has assumed the maximum compression condition.

Figure 5:
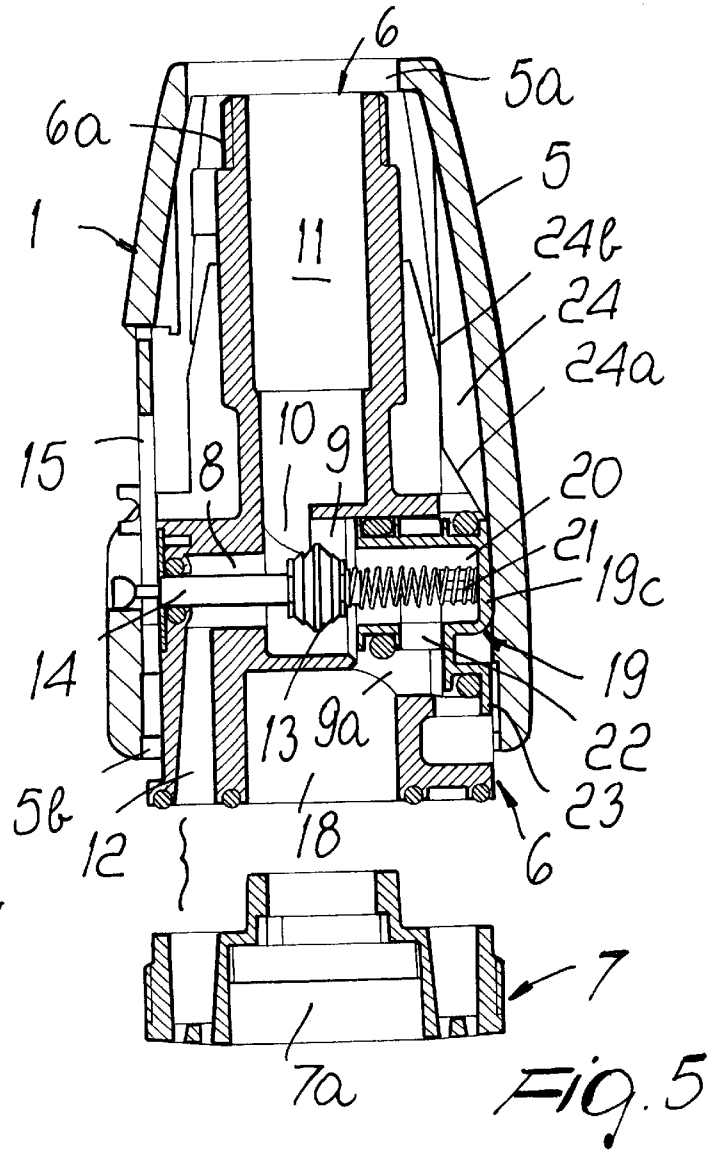
FIGS. 4, 5 and 6 are views of three successive steps of the assembly of the invention.

As the insertion of the central body 6 continues, one reaches the condition of FIG. 5, in which the end of the rod 14 has arranged itself at the opening 15 and can protrude from it, pushed by the spring 21.

Figure 6:
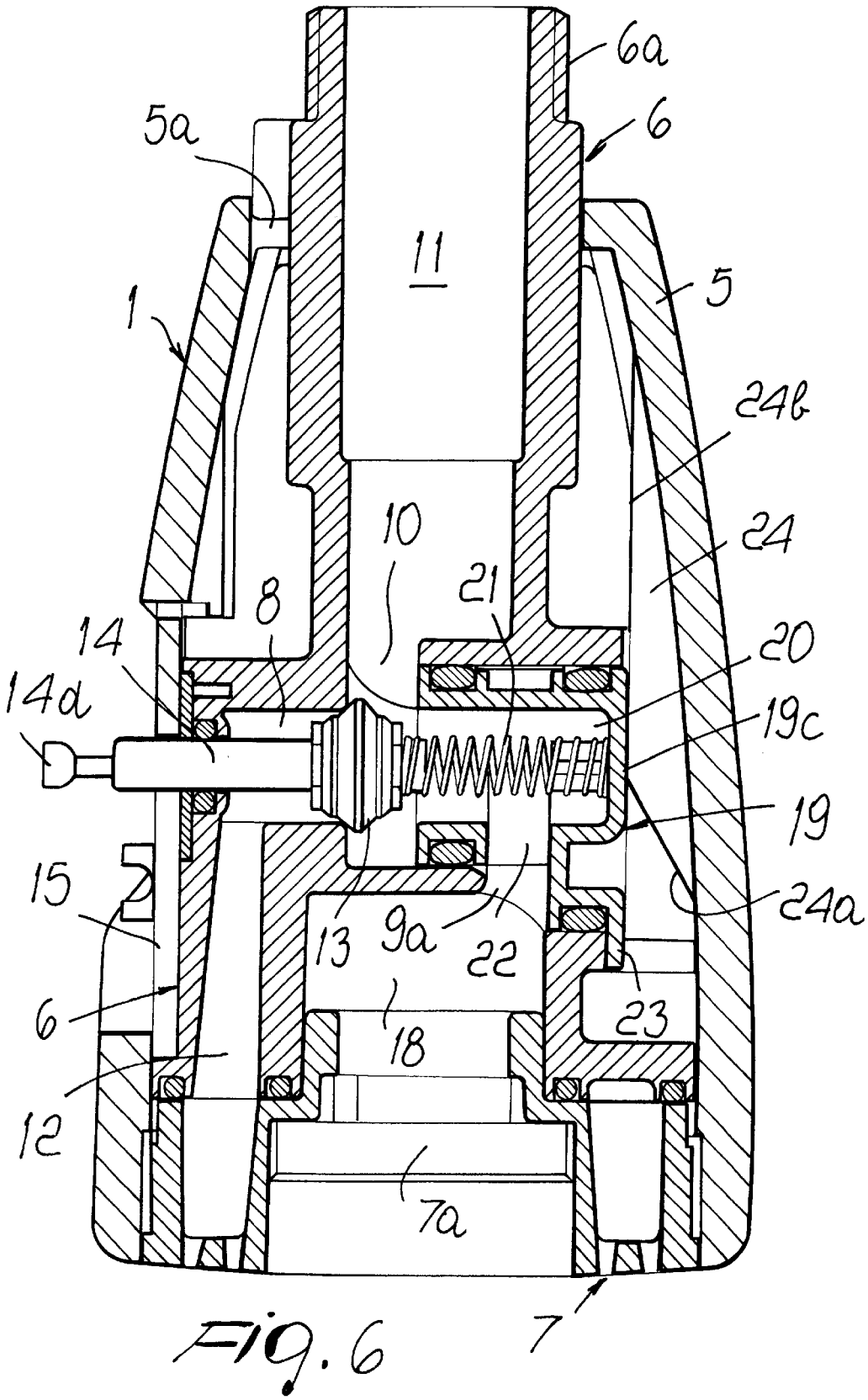

From this moment onward, by virtue of the appropriate arrangement of the ridge 24, the further insertion of the central body 6 produces the movement of the slider 19 which, appropriately guided by the tooth 23, is pushed by the portion 24*a* of said ridge to the active position shown in FIG. 6, which is rendered stable by the contact of the portion 24*b* of the ridge with the bottom 19*c* of the slider, which has the tooth 23 in contact with an abutment and locking surface.

Final closure occurs by screwing the disk 7 onto the enclosure 5, and the operation is completed, just before fully closing said disk 7, by assembling the button 14*c,* the lever 16 and the hood 17.

A second embodiment of the invention is now described with reference to FIGS. 7 and 8; such embodiment comprises the outer enclosure 25, which has the two mutually opposite openings 25*a* and 25*b* and internally contains the central body 26, which is adapted to convey water from the intake end, being provided with a thread 26*a* for coupling to a flexible hose such as 4.

The central body 26 is locked within the outer enclosure 25 by virtue of the disk 27, which is associated by means of an internal thread, with the thread 25*c* provided on the outer surface of said enclosure and is suitable to abut with said central body 26 at the water delivery end; said disk 27 of course comprises a central water delivery port, which is provided with the filters and aerator set 27*a,* and ports such as 27*b,* 27*c,* 27*d* for providing the peripheral jet.

The central body 26 comprises, like the previously described central body 6, a cavity which is arranged substantially transversely to the water delivery direction and is divided into two facing portions 28, 29 which lie on opposite sides with respect to the opening 30 that connects said cavity to the duct 31 that branches off from the water intake end.

In a manner similar to what occurs for the previously described cavity portion 8, the cavity portion 28 has a port 28*a* for delivering the water toward the duct 32, which is connected to the ports such as 27*b,* 27*c,* 27*d* of the disk 27 that provide the peripheral jet, and is shaped at the water intake section so as to form the surface 28*b* for providing a seal by abutment with the flow control element 33 connected to the rod 34, which is fully identical to the flow control element 13 of the previously described embodiment.

Said rod 34 protrudes from the bottom of the cavity portion 28 and protrudes from the opening 35 that lies longitudinally on the wall of the outer enclosure 25 in the form of a notch which is open at the opening 25*b* of said enclosure; in this manner, the rod is associated with the actuation lever 36 which is pivoted to the support 36*a* and is covered, together with the button 34*a* arranged at the end of said rod, by the hood 37 made of elastic material, all as described with reference to the first embodiment.

The cavity portion 29 is provided with the port 29*a* for delivering the water toward the portion of space 38 that is connected to the central port of the disk 27 and is suitable to contain the fixed plug 39, which is associated therewith by virtue of the thread 39*a* and is provided with the sealing gaskets 39*b,* 39*c.*

Said plug 39 comprises the cavity 40, which has a water intake opening which is delimited by the surface 40*a* for forming a seal by abutment with the flow control element 33, and contains the spring 41, associated with the bottom of the plug 29, for the actuation of said flow control element 33; reference numeral 42 furthermore designates a port which is provided in the wall of the fixed plug 39 and is suitable to connect the cavity 40 to the water delivery port 29*a*.

The assembly of this embodiment of the invention first of all entails forming the assembly that comprises the plug 39 with the spring 41 and the flow control element 33 with the corresponding rod 34 and screwing or force keying said plug 39 into the seat formed within the portion 29 of the cavity of the central body 6.

Figure 7:
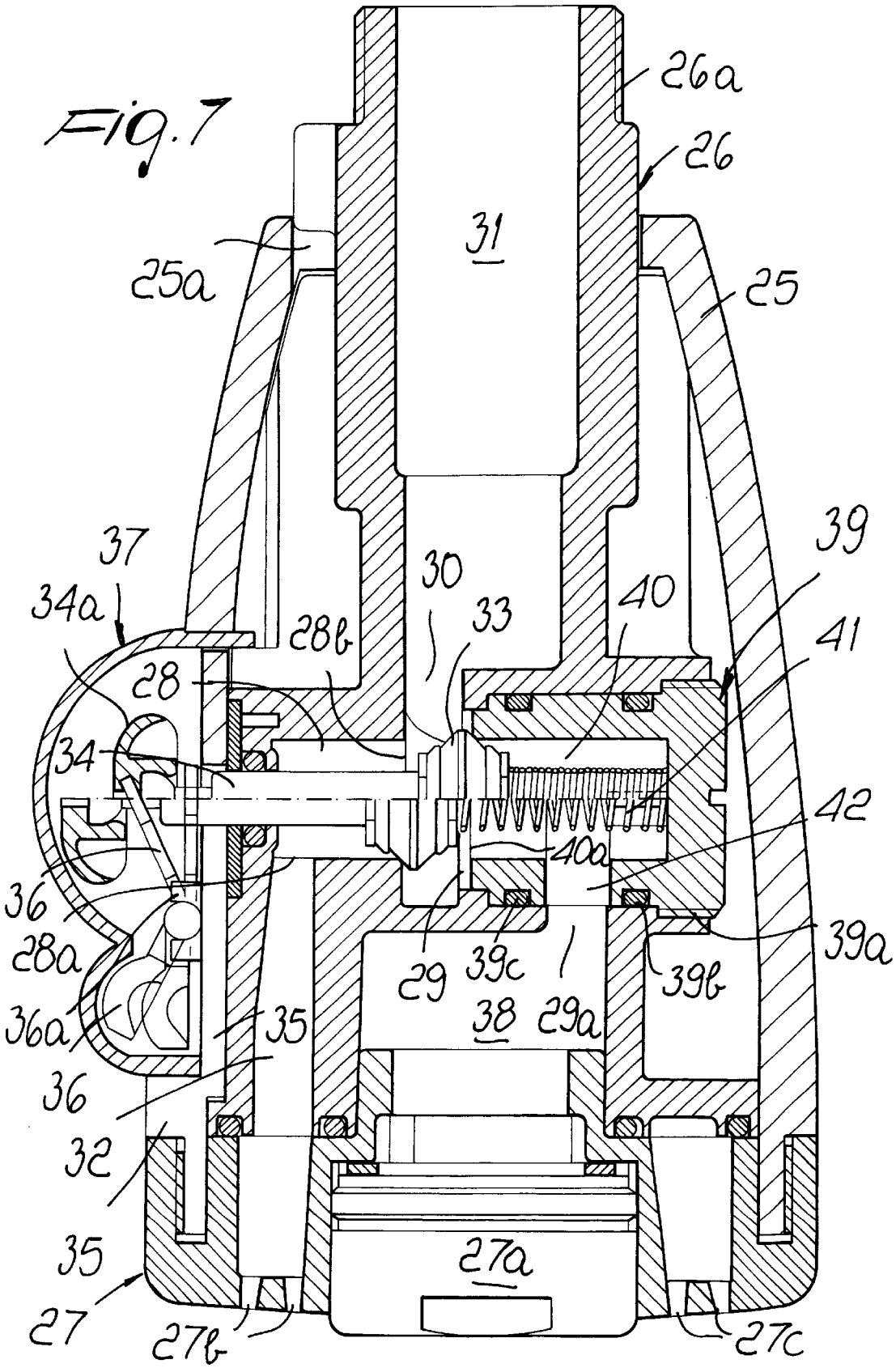
FIGS. 7 and 8 are, respectively, a longitudinal sectional view and an exploded view of a second embodiment according to the invention.
Figure 8:
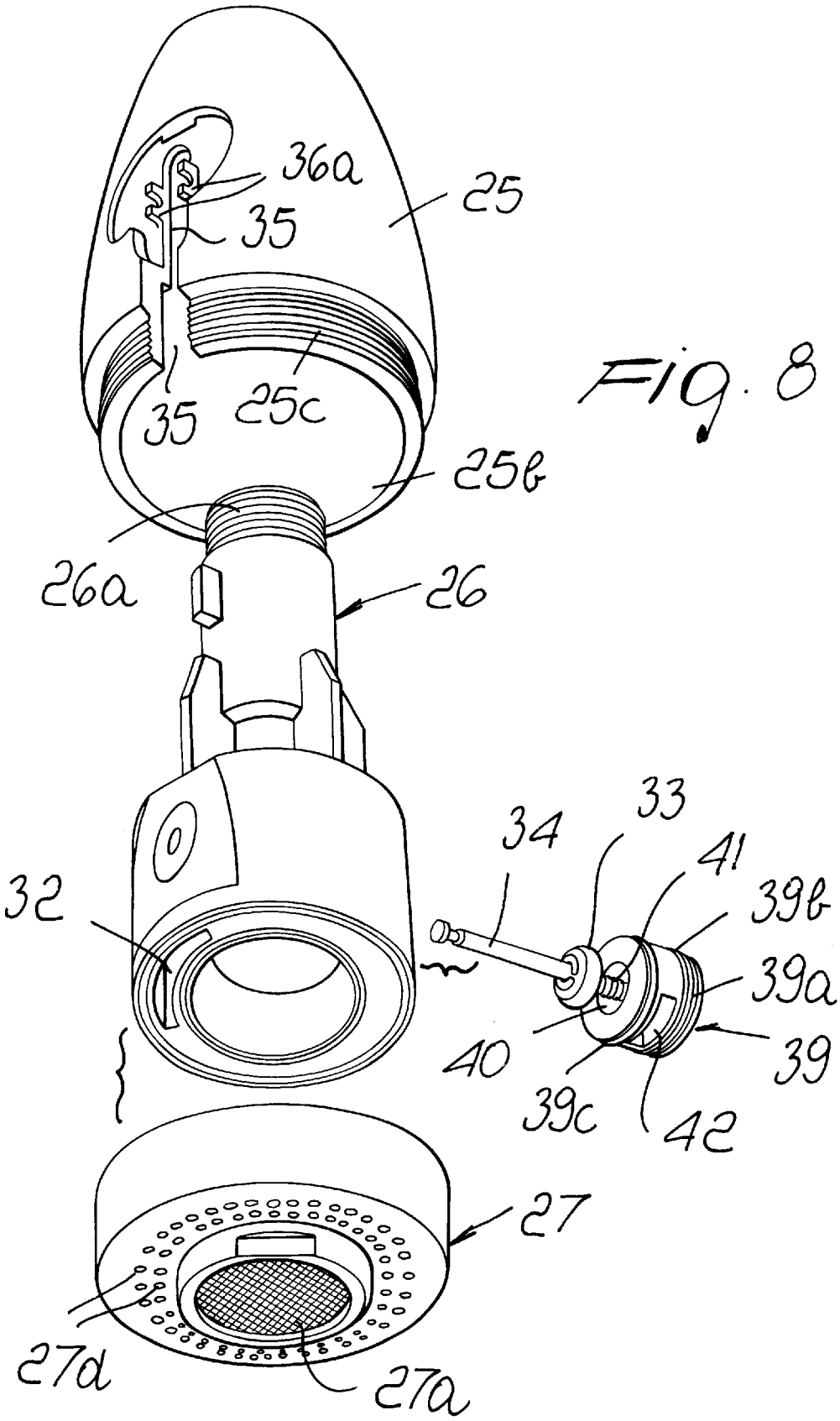

At this point, the central body 26 is inserted in the outer enclosure 25 and is moved to the operating condition shown in FIG. 7 without encountering any obstacle, since the rod 34 enters and slides in the opening 35 formed as a notch, which is open at the end.

Final closure occurs by screwing the disk 27, which by surrounding from the outside the enclosure 25 ensures its absolute compactness, and the operation is completed, before fully tightening the disk, by assembling the button 34*a,* the lever 36 and the hood 37.

A third embodiment of the invention is now described with reference to FIG. 9 and comprises the water conveyance body 43, which is provided at its intake end with a thread 43*a* for coupling to a flexible hose such as 4 and with which the disk 44 is associated by means of a thread at the delivery end; said disk has a central port, which is provided with the filter and aerator set 44*a,* and ports such as 44*b,* 44*c* for providing the peripheral jet.

Said body 43 internally has a configuration which is fully similar to the configuration of the central body 26 of the previously described variation, and this is true also for the elements associated therewith, such as the flow control element with the corresponding rod, the fixed plug for the abutment of the contrast spring of said flow control element, and the hood for covering the actuation lever; it is merely noted that in this embodiment said rod of the flow control element protrudes from the body 43, passing through a circular hole protected by the gasket 45.

A fourth embodiment of the invention is described with reference to FIG. 10; such fourth embodiment comprises the water conveyance body 46, with a thread 46*a* at the intake end, and is provided, at the delivery end, with the disk 47, which has a central port provided with the filter and aerator set 47*a,* and ports such as 47*b,* 47*c* for providing the peripheral jet.

Figure 9:
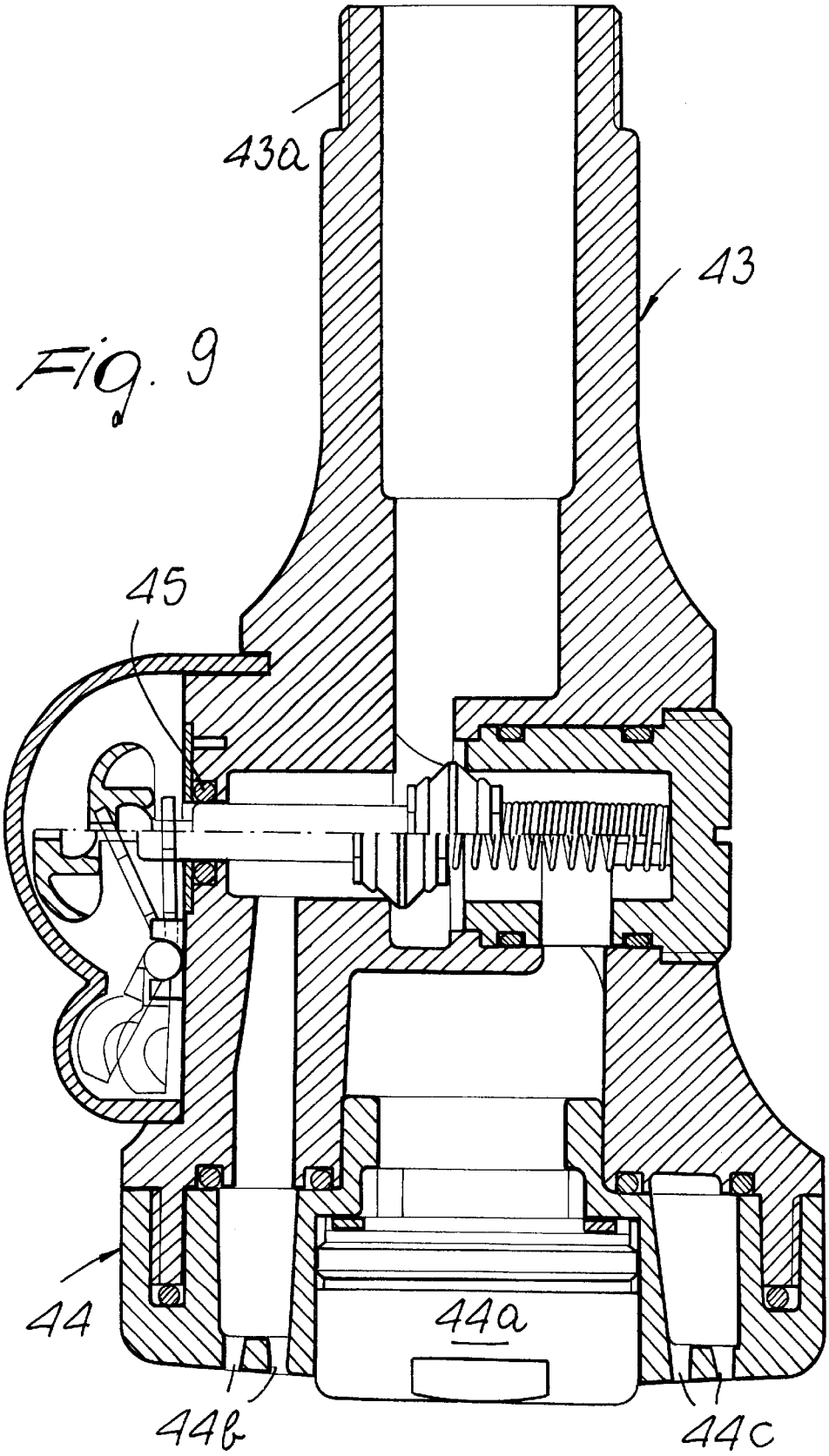
FIGS. 9, 10 and 11 are longitudinal sectional views of further embodiments according to the invention.

The configuration of the body 46 is fully similar to the configuration of the body 43 shown in FIG. 9, the only change being the fact that the plug 48 is located at the bottom of the portion 49 of the transverse cavity from which the rod of the flow control element protrudes, without altering the fact that said cavity portion is connected to the duct 50 which conveys water to the disk 47 in order to form the peripheral jet, while the water for forming the central jet reaches the portion of space 51 by arriving from the transverse cavity portion 52 whose bottom is formed monolithically within the body 46.

The shape and operation of the flow control element of course remain unchanged.

A placement of the plug 48 such as the one described might also be provided in the embodiment shown in FIG. 7 described earlier.

Figure 11:
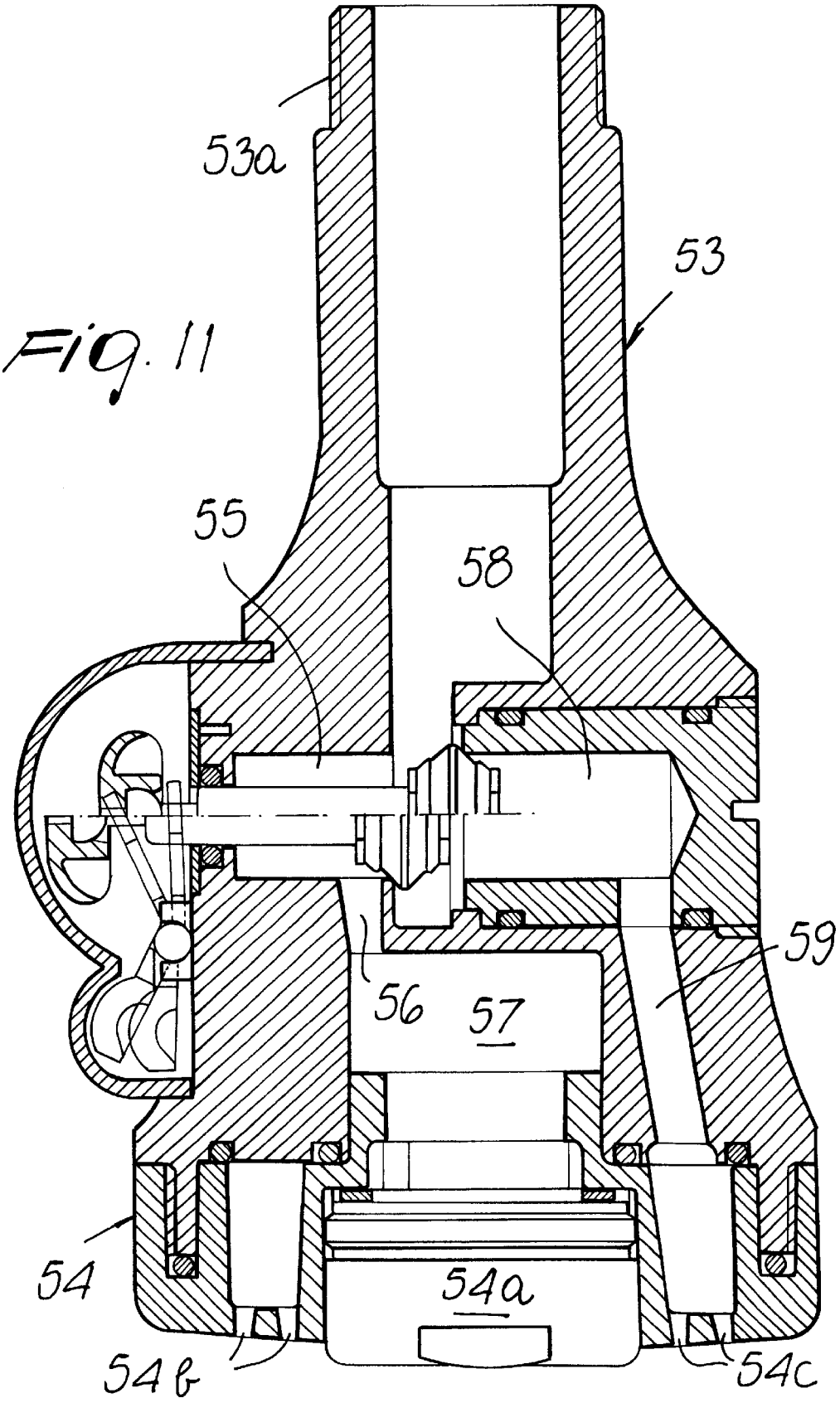

The embodiment shown in FIG. 11, described hereafter, comprises the water conveyance body 53, which has a thread 53*a* at the intake end and is provided, at its delivery end, with the disk 54 with a central port provided with the filter and aerator set 54*a,* and with ports such as 54*b,* 54*c* for providing the peripheral jet.

The modification, that the body 53 has with respect to the body 43 described in FIG. 9, consists in that the transverse cavity portion 55 from the bottom of which the rod of the flow control element protrudes is connected, by means of the duct 56, to the portion of space 57 that conveys the water to the central jet, while the portion 58 of said transverse cavity is connected, by means of the duct 59, to the holes of the disk 54 that form the peripheral jet.

Figure 10:
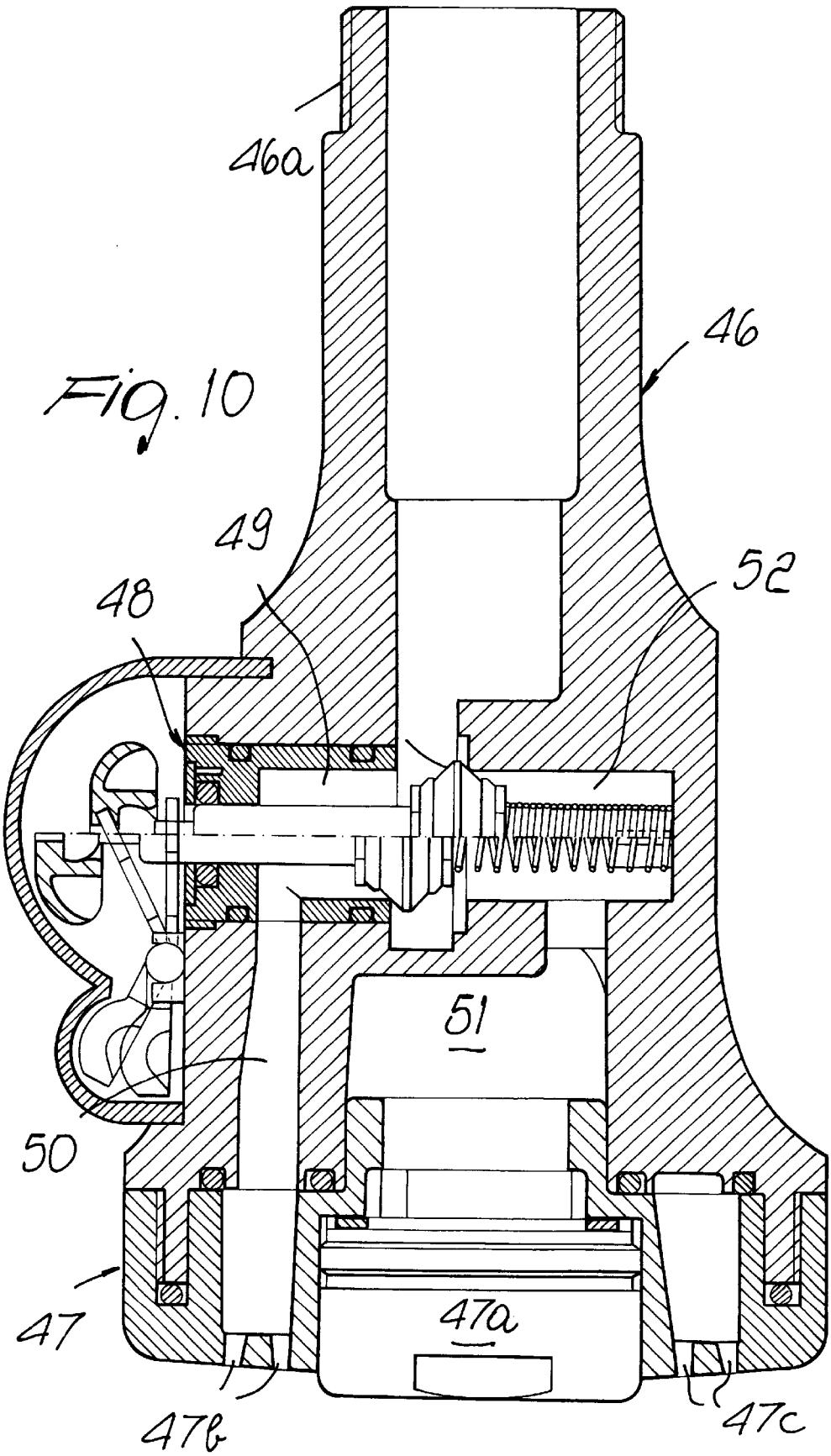

A modification, such as the one described above with regard to the embodiment shown in FIG. 9, can also be performed in the embodiments shown in FIGS. 2, 7 and 10, and this is true also for the further modification that can be noticed in FIG. 11, which consists of the absence of the actuation spring of the flow control element, which is otherwise unchanged.

The described invention is susceptible of numerous other modifications and variations, all of which are within the scope of the inventive concept; all the details may further be replaced with other technically equivalent elements.

What is claimed is:

1. A pull-out shower head for a kitchen, comprising: a central water conveyance body; coupling means, provided at a water intake end of the body, for coupling to a flexible hose accommodatable within a faucet; a disk provided at a water delivery end of the body, and including a central port and peripheral ports for water passage; a cavity of said body, which is arranged substantially transversely to a water delivery direction; a duct which branches off from said intake end, said cavity having an opening toward said duct and being divided into two facing portions which lie on opposite sides with respect to said opening, each said portion comprising a water delivery port thereof, a first one of said water delivery ports being connectable to said peripheral ports, and a second one of said water delivery ports being connectable to said central port for water passage that is comprised within said disk; a hollow plug being provided at a first one of said portions, said hollow plug comprising at a wall portion thereof, a connection port for connection to said water delivery port that is comprised within said first one of said facing portions; and a flow control element having a rod which protrudes externally from the body to an actuation lever connected to said rod, said flow control element being actuatable to abut, on opposite sides thereof, with sealing surfaces provided respectively, at a water intake section of a second one of said facing portions and at a face of a cavity of the hollow plug comprised within the first one of said facing portions.

2. The shower head of claim 1, further comprising an outer enclosure provided with two openings, said central water conveyance body being contained within the outer enclosure in order to be locked therein by way of said disk located at the water delivery end, the disk being further connected to a first one of said openings of said outer enclosure, said central body being provided, at the water intake end which is located at the second one of said openings, with said coupling means for coupling to the flexible hose.

3. The shower head of claim 2, further comprising: a button located at an end of said rod, and a hood for covering the actuation lever of the rod of the flow control element, said hood being made of elastic material and being shaped so as to form two regions which have differentiated dimensions and lie over the end of said lever and over said button, respectively.

4. The shower head of claim 3, wherein said hood for covering the lever of the rod of the flow control element is provided with end tabs which are insertable in appropriately provided openings of said outer enclosure in order to lock the hood in position on the enclosure.

5. The shower head of claim 4, wherein said button is located at a partially spherical end of said rod and includes a flat face which prevents abnormal movements.

6. The shower head of claim 2, further comprising a protection gasket located at a passage hole of said second one of said facing portions for outward passage of said rod of the flow control element; and a locking plate coupled with a surface adjacent to said passage hole for locking said gasket in position.

7. The shower head of claim 6, comprising a flow control element actuation spring.

8. The shower head of claim 2, wherein said outer enclosure has an outer shape formed so as to enable comfortable hand gripping.

9. The shower head of claim 8, wherein said outer enclosure is shaped as a solid of revolution with said two openings located at opposite ends thereof.

10. The shower head of claim 2, wherein said disk locks the central water conveyance body within said outer enclosure by screwing on a thread located at said first one of said openings of said outer enclosure, said disk further accommodating a filter and aerator set arranged at said central port thereof.

11. A shower head comprising: an outer enclosure provided with two openings; a central water conveyance body contained within the outer enclosure; an abutment disk located at a first water delivery end of the outer enclosure for locking said central body within said outer enclosure, said disk being connected to a first one of said openings of said outer enclosure and comprising a central port and peripheral ports for water passage, said central body being provided, at a water intake end of said outer enclosure which is located at a second one of said openings of said outer enclosure, with coupling means for coupling to a flexible hose is comprised within a faucet; a duct which branches off from the water intake end; a cavity formed in said central body, which is arranged substantially transversely to a water delivery direction, is provided with a cavity opening toward said duct and is divided into first and second facing portions which lie on opposite sides with respect to said cavity opening; a flow control element; a rod connected to said flow control element so as to protrude from a bottom of said first facing portion through a longitudinal opening which extends longitudinally through a wall of said outer enclosure; an actuation lever connected to said rod; a plug, accommodated in said second facing portion, which comprises a plug cavity having, at one end, a water intake cavity opening delimited by a surface for forming a seal by abutment against said flow control element; and a spring accommodated in said plug cavity for biasing said flow control element, and wherein said first facing portion is provided with a water delivery port which is connectable to the peripheral water passage ports of said abutment disk and is shaped, at a water intake section, so as to form a surface for sealing by abutment against said flow control element; and said second facing portion is provided with a water delivery port which is connectable to the central water passage port of said abutment disk and accommodates said plug, and comprises, at a wall part thereof, a connection port for connection to said central water passage port for water delivery from the second facing portion.

12. The shower head of claim 11, further comprising a ridge which protrudes from an internal surface of the wall of said outer enclosure; and a said longitudinal opening that extends longitudinally through the wall of the outer enclosure is slot-shaped so as to allow protrusion of the rod of the flow control element, said plug being constituted by any of a movable plug and a slider, which is movable during insertion of the central body in the outer enclosure in order to be placed in an active position and be locked thereat by said ridge.

13. The shower head of claim 12, wherein said abutment disk is associated, through a thread provided at its outer surface, with one of said first one of said openings of said outer enclosure.

14. The shower head of claim 12, wherein the slider is provided with a tooth which is arrangeable into an active position in contact with an abutment surface formed within the central body, by moving within a guide formed in said central body.

15. The shower head of claim 14, wherein the ridge that protrudes from the internal surface of the wall of the outer enclosure makes contact with a bottom part of the slider and has:

a first portion, which is inclined so as to allow movement of said slider until the active position is reached during insertion of the central body in the outer enclosure from a position in which a bottom part of said slider is in contact with said internal surface, said first inclined portion being arranged so as to determine beginning of said movement substantially from a position of the central body in which the rod of the flow control element protrudes from the longitudinal opening that extends longitudinally through said wall of the outer enclosure; and a second portion, which is longitudinal for arrangement thereof in contact with the bottom part of the slider in the active position.

16. The shower head of claim 11, wherein said plug is a fixed plug, the longitudinal opening that extends longitudinally through the wall of said outer enclosure is formed as a notch which is open at the water delivery end in order to allow the rod of the flow control element to protrude, the abutment disk having an internal thread which is complementary to a thread formed on the outer surface of said outer enclosure whereby to lock the central body by screwing within the outer enclosure.

17. The shower head of claim 16, wherein the fixed plug is connected to the second facing portion by way of a thread.

18. The shower head of claim 16, wherein the fixed plug is connected to the second facing portion by forced keying.

19. A kitchen shower head for connection to a flexible hose comprised within a faucet, comprising: a central water conveyance body; coupling means located at a water intake end of the central body for coupling to the flexible hose; a disk connected to a thread provided proximate to a delivery end of said central body, said disk having a central port and peripheral ports for water passage; a duct which branches off from the water intake end, said body comprising a cavity which is arranged substantially transversely to a water delivery direction and provided with a cavity opening toward said duct, said cavity being divided into two facing portions which protrude on opposite sides with respect to said cavity opening, each one of said portions comprising a water delivery port, a first one of said ports being connectable to the peripheral ports, a second one of said ports being connectable to the central port comprised within said disk; a fixed hollow plug accommodated within a first one of said portions, said plug comprising at a wall part thereof, a plug port for connection to the water delivery port comprised within said first one of said facing portions; a flow control element arranged so as to abut, on opposite sides thereof, against sealing surfaces at a water intake section of, respectively, a second one of said facing portions free from said plug and a plug cavity that is comprised in the first one of said facing portions; an actuation lever; and a rod connected to said actuation lever and protruding outward from said central body.

* * * * *

US006370713C1

(12) EX PARTE REEXAMINATION CERTIFICATE (9831st)

United States Patent
Bosio

(10) Number: US 6,370,713 C1
(45) Certificate Issued: Sep. 6, 2013

(54) PULL-OUT SHOWER HEAD FOR KITCHEN

(75) Inventor: Orlando Bosio, Casaloldo (IT)

(73) Assignee: AMFAG S.p.A., Castelgoffredo (IT)

Reexamination Request:
No. 90/011,952, Oct. 11, 2011

Reexamination Certificate for:

| | |
|---|---|
| Patent No.: | **6,370,713** |
| Issued: | **Apr. 16, 2002** |
| Appl. No.: | **09/797,573** |
| Filed: | **Mar. 5, 2001** |

(30) Foreign Application Priority Data

Mar. 10, 2000 (IT) ..... MN00A0013

(51) Int. Cl.
*E03C 1/05* (2006.01)
*B05B 1/16* (2006.01)

(52) U.S. Cl.
USPC ..... 4/677; 239/441; 239/449; 239/548; 239/553.3; 239/553.5; 239/558; 239/562; 239/586

(58) Field of Classification Search
None
See application file for complete search history.

(56) References Cited

To view the complete listing of prior art documents cited during the proceeding for Reexamination Control Number 90/011,952, please refer to the USPTO's public Patent Application Information Retrieval (PAIR) system under the Display References tab.

*Primary Examiner* — Joseph A. Kaufman

(57) ABSTRACT

A pull-out spray head, which is connectable with a faucet by a flexible hose, has a water conveyance body disposed within an outer enclosure. The water conveyance body has a cavity which is arranged substantially transversely to the water delivery direction, has an opening facing toward the water intake duct defined by the body, and is divided into two facing portions on opposite sides with respect to the opening. Each facing portion has a water delivery port connected, respectively, to the peripheral ports and to the central port of a disk which locks the body within the enclosure. One of the facing portions is provided with a hollow plug or slider which includes a port for connection to the water delivery port of that one facing portion. A flow control element is positioned within the body and has a rod which protrudes outwardly of the enclosure so as to be connected to an actuation lever.

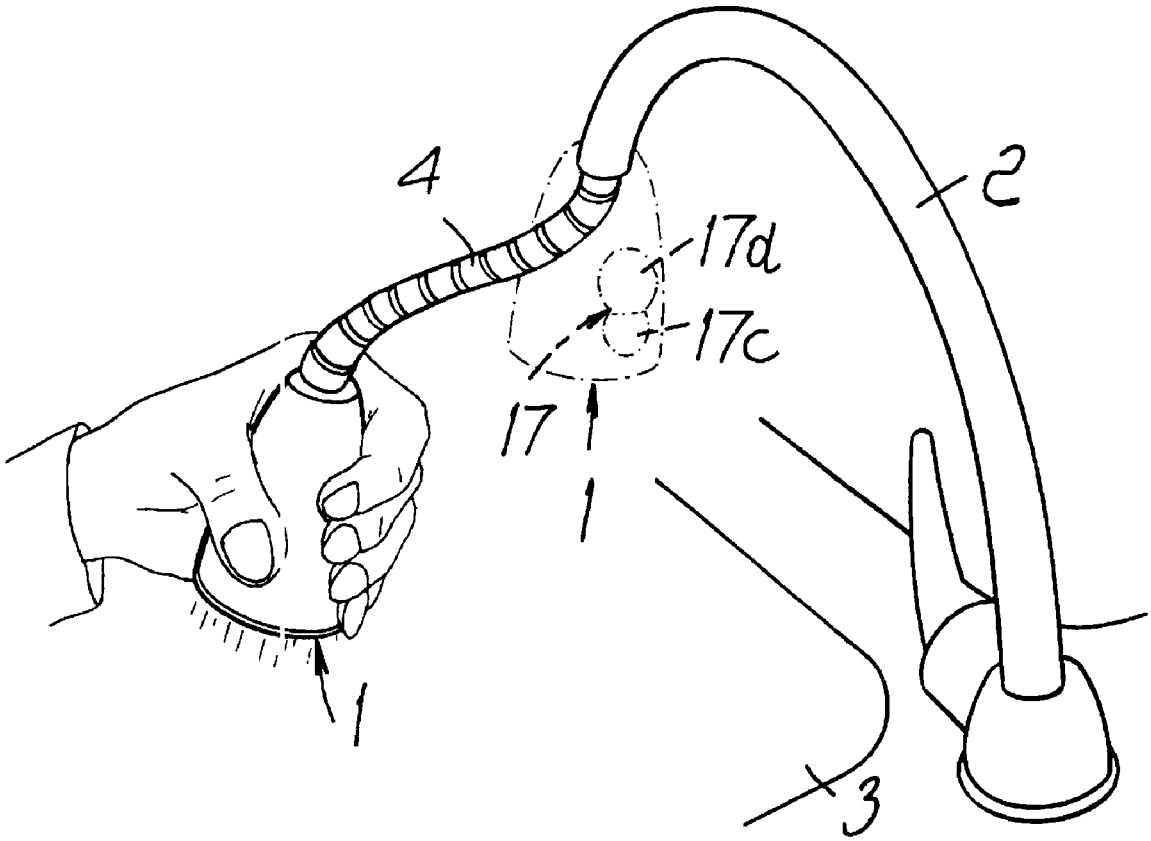

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 1 is confirmed.

New claims 20-32 are added and determined to be patentable.

Claims 2-19 were not reexamined.

*20. The shower head of claim 1, wherein the water delivery direction from the water delivery end of the body corresponds to a direction of water conveyance into the water intake end of the body.*

*21. The shower head of claim 1, further comprising:*

*the water intake end having an opening, and the water delivery end having an opening, wherein the opening of the water intake end and the opening of the water delivery end are positioned on opposite ends of a longitudinal axis of the shower head and aligned with the longitudinal axis.*

*22. The shower head of claim 1, wherein a direction of water conveyance from the water delivery end of the body is aligned with a direction of water conveyance into the water intake end of the body.*

*23. The shower head of claim 1, wherein the water intake end includes a first opening in the central water conveyance body and the water delivery end includes a second opening in the central water conveyance body, the first opening coaxial with the second opening.*

*24. The shower head of claim 1, wherein the water intake end includes a first opening in the central water conveyance body and the water delivery end includes a second opening in the central water conveyance body, the first opening and the second opening positioned on a longitudinal axis of the water conveyance body.*

*25. A pull-out shower head for a kitchen, comprising:*

*a central water conveyance body having a water intake end having an opening and a water delivery end having an opening, the water intake end and the water delivery end disposed along a longitudinal axis of the shower head, with the opening of the water intake end and the opening of the water delivery end aligned with the longitudinal axis;*

*coupling means, provided at the water intake end of the body, for coupling to a flexible hose accommodatable within a faucet;*

*a disk provided at the water delivery end of the body, and including a central port and peripheral ports for water passage;*

*a cavity of said body, which is arranged substantially transversely to a water delivery direction;*

*a duct which branches off from said intake end, said cavity having an opening toward said duct and being divided into two facing portions which lie on opposite sides with respect to said opening, each said portion comprising a water delivery port thereof,*

*a first one of said water delivery ports being connectable to said peripheral ports, and a second one of said water delivery ports being connectable to said central port for water passage that is comprised within said disk;*

*a hollow plug being provided at a first one of said portions, said hollow plug comprising at a wall portion thereof, a connection port for connection to said water delivery port that is comprised within said first one of said facing portions; and*

*a flow control element having a rod which protrudes externally from the body to an actuation lever connected to said rod, said flow control element being actuatable to abut, on opposite sides thereof, with sealing surfaces provided respectively, at a water intake section of a second one of said facing portions and at a face of a cavity of the hollow plug comprised within the first one of said facing portions.*

*26. The shower head of claim 25, wherein the central water conveyance body is configured to convey water from the water intake end through the water delivery end along the longitudinal axis of the shower head.*

*27. The shower head of claim 25, wherein the central water conveyance body is configured to deliver water from the water delivery end in a direction of the longitudinal axis of the shower head.*

*28. The shower head of claim 25, wherein a direction of water conveyance from the water delivery end is co-axial with a direction of water conveyance into the water intake end.*

*29. The shower head of claim 25, wherein a direction of water conveyance from the water delivery end is substantially parallel with a direction of water conveyance into the water intake end.*

*30. The shower head of claim 25, wherein a direction of water conveyance from the water delivery end is aligned with a direction of water conveyance into the water intake end.*

*31. The shower head of claim 25, wherein the water intake end includes an intake duct and wherein the central port of the disk provided at the water delivery end of the body is coaxial with the intake duct.*

*32. The shower head of claim 31, wherein the peripheral ports in the disk are concentric with the central port in the disk.*

* * * * *